US006182683B1

(12) United States Patent
Sisk

(10) Patent No.: US 6,182,683 B1
(45) Date of Patent: Feb. 6, 2001

(54) WATER RECIRCULATION MANIFOLD

(75) Inventor: David Sisk, Oceanside, CA (US)

(73) Assignee: Temtrol, delta T. Inc., Oceanside, CA (US)

( * ) Notice: Under 35 U.S.C. 154(b), the term of this patent shall be extended for 0 days.

(21) Appl. No.: 09/382,230

(22) Filed: Aug. 24, 1999

(51) Int. Cl.[7] ..... F16K 49/00

(52) U.S. Cl. ..... 137/337; 137/563; 137/624.11; 417/32

(58) Field of Search ..... 417/32; 137/563, 137/337, 624.11

(56) References Cited

U.S. PATENT DOCUMENTS

| | | | | |
|---|---|---|---|---|
| 3,096,021 | | 7/1963 | Lintvedt . | |
| 3,894,556 | * | 7/1975 | Pareja | 137/539 |
| 4,142,515 | | 3/1979 | Skaats . | |
| 4,201,518 | | 5/1980 | Stevenson . | |
| 4,606,325 | | 8/1986 | Lujan, Jr. . | |
| 4,697,614 | * | 10/1987 | Powers et al. | 137/337 |
| 4,945,942 | | 8/1990 | Lund . | |
| 5,009,572 | * | 4/1991 | Imhoff et al. | 417/32 |
| 5,042,524 | * | 8/1991 | Lund | 137/337 |
| 5,105,846 | * | 4/1992 | Britt | 137/337 |
| 5,277,219 | | 1/1994 | Lund . | |
| 5,323,803 | * | 6/1994 | Blumenauer | 137/337 |
| 5,339,859 | * | 8/1994 | Bowman | 137/337 |
| 5,385,168 | * | 1/1995 | Lund | 137/337 |
| 5,452,740 | * | 9/1995 | Bowman | 137/337 |
| 5,511,579 | * | 4/1996 | Price | 137/337 |
| 5,735,291 | * | 4/1998 | Kaonohi | 137/337 |
| 5,944,221 | * | 8/1999 | Laing et al. | 222/54 |
| 5,979,788 | * | 11/1999 | Rancourt et al. | 239/11 |
| 5,983,922 | * | 11/1999 | Laing et al. | 137/338 |

* cited by examiner

*Primary Examiner*—A. Michael Chambers
*Assistant Examiner*—Thomas L. McShane
(74) *Attorney, Agent, or Firm*—Knobbe Martens Olson & Bear, LLP

(57) ABSTRACT

A water recirculation system is disclosed for moving water from a hot water tap to a cold water tap. The recirculation system includes a water manifold that houses a pump, solenoid, check valve and temperature switch. Water is moved between these components within the water manifold so that external piping is unnecessary.

19 Claims, 7 Drawing Sheets

WATER RECIRCULATION MANIFOLD

BACKGROUND OF THE INVENTION

1. Field of the Invention

This invention relates to water recirculation systems. More specifically, this invention relates to an integrated manifold within a water recirculation system that houses a water pump, a solenoid, a check valve, and a temperature switch.

2. Description of the Related Art

As interest in water conservation has grown, many devices have been designed for home water conservation. One such class of water conservation devices are known as water recirculators. These devices address the conservation problem created by individuals that turn on their hot water faucets and run the water tap until hot water emerges. This waste of cool water down the drain has been addressed by devices that slowly and constantly recirculate water from the hot water heater into the cold water tap so that hot water is always available at the faucet.

For example, many devices exist that are placed underneath a sink in the home and connect the hot water tap to the cold water tap. These devices normally include a pump for moving water from the hot water tap to the cold water tap to provide instant hot water once the faucet is turned on. Some devices also include a timer so that water is only recirculated during times that people are usually present in the home.

One such device is described in U.S. Pat. No. 5,009,572 to Imhoff. The Imhoff device includes a hot water supply line and a cold water supply line. An electric motor pumps water from the hot water supply line to the cold water supply line by passing through a solenoid valve. A temperature sensor is provided for detecting the water temperature at the inlet port of the pump and turning on the pump once the water temperature of the hot water falls below a preset level. A series of hollow tubes is used to connect each component of the Imhoff system with other components. This series of tubes running between components makes the Imhoff device complicated to produce, expensive to maintain, and expensive to manufacture.

Another water recirculation system is disclosed in the U.S. Pat. No. 5,511,579 to Price. The Price system also includes a hot water inlet, cold water outlet, and recirculation pump for moving water from the hot water inlet to the cold water outlet. This system also includes a temperature switch mounted in a plastic housing for determining the temperature of water entering the recirculation device.

The temperature switch mounted into the plastic housing determines the temperature of water flowing from the hot water inlet. The housing also contains a port for directing the hot water away from the temperature switch and into a tube that is connected to a recirculation pump. The recirculation pump connects to another tube that runs to a solenoid switch. The solenoid switch in turn is connected to a tube that moves water to a check valve. The water passing over the check valve moves into a tube that thereafter connects to the cold water outlet. The check valve also includes a port to move water through a "back-flow" tube into the temperature switch manifold in order to recirculate a portion of the hot water back over the temperature switch. This helps prevent overheating of the water in the cold water line.

However, this system is expensive to manufacture because of the numerous tubes connecting the each component within the recirculation system. Thus, what is needed in the art is a recirculation system that is compact and inexpensive to manufacture in high-volume. Such a system is described below.

SUMMARY OF THE INVENTION

One embodiment of the invention is a water recirculation manifold that includes a hot water inlet; a first internal lumen connecting the hot water inlet to a first chamber, wherein the first chamber is adapted to receive a temperature switch; a second internal lumen connecting the first chamber to a second chamber, wherein the second chamber is adapted to receive a pump; and a third internal lumen connecting the second chamber to a cold water outlet.

Another embodiment of the invention is a fluid recirculation system that includes a hot water inlet and a manifold that has: a first internal lumen connecting the hot water inlet to a first chamber, wherein the first chamber is removably connected to a temperature switch; a second internal lumen connecting the first chamber to a second chamber, wherein the second chamber is removably connected to a pump; and a third internal lumen connecting the second chamber to a cold water outlet.

Yet another embodiment of the invention is a fluid recirculation system, having: a hot fluid inlet and a manifold comprising: a first internal lumen connecting the hot fluid inlet to a first chamber, wherein the first chamber is removably connected to a temperature switch; a second internal lumen connecting the first chamber to a second chamber, wherein the second chamber is removably connected to a pump; a third internal lumen connecting the second chamber to a cold fluid outlet; a third chamber connected to the second chamber and the cold fluid outlet, wherein the third chamber is removably connected to a check valve; and a fourth chamber connected to the third chamber and the cold fluid outlet, wherein the fourth chamber is adapted to receive a solenoid valve.

DETAILED DESCRIPTION

Embodiments of the invention relate to water recirculation systems that provide instant hot water at the faucet. A hot water supply line runs from a remotely located supply source, such as a water heater, to an inlet port of the recirculation system. After passing through the inlet port, the hot water enters an integrated water manifold. Within the manifold are mounting areas for a temperature sensor, water pump, check valve, and solenoid.

The temperature sensor is in electrical contact with the water pump and solenoid valve so that the pump and solenoid are only activated when the water temperature at the inlet drops below a predetermined temperature. When the system is activated by a low temperature reading at the inlet, the pump begins pulling water from the inlet and pushing water out the outlet of the integrated manifold. The outlet of the manifold is connected to the cold water line in the house so that the water recirculates back into the cold water line.

As will be discussed more specifically below, a check valve is positioned within the integrated manifold to provide a unidirectional water flow so that once the water pump stops, water does not flow in the reverse direction through main channels of the manifold and only a controlled amount of water can return to the hot water line via the backflow line. The check valve consists of a ball which is spring loaded into closed position. However, it should be noted that other well known types of check valves are anticipated to function in a similar manner and be within the scope of the invention.

Also located in the integrated manifold is a solenoid consisting of a diaphragm, pin, and spring. When electrically disengaged, the pin deploys and closes the diaphragm which prevents hot water from continuing to the cold water line. It should be noted that the design allows water to flow in the reverse direction, into the backflow channel, while the solenoid is disengaged. However, water is prevented from entering other portions of the manifold by the check valve.

Figure 1:
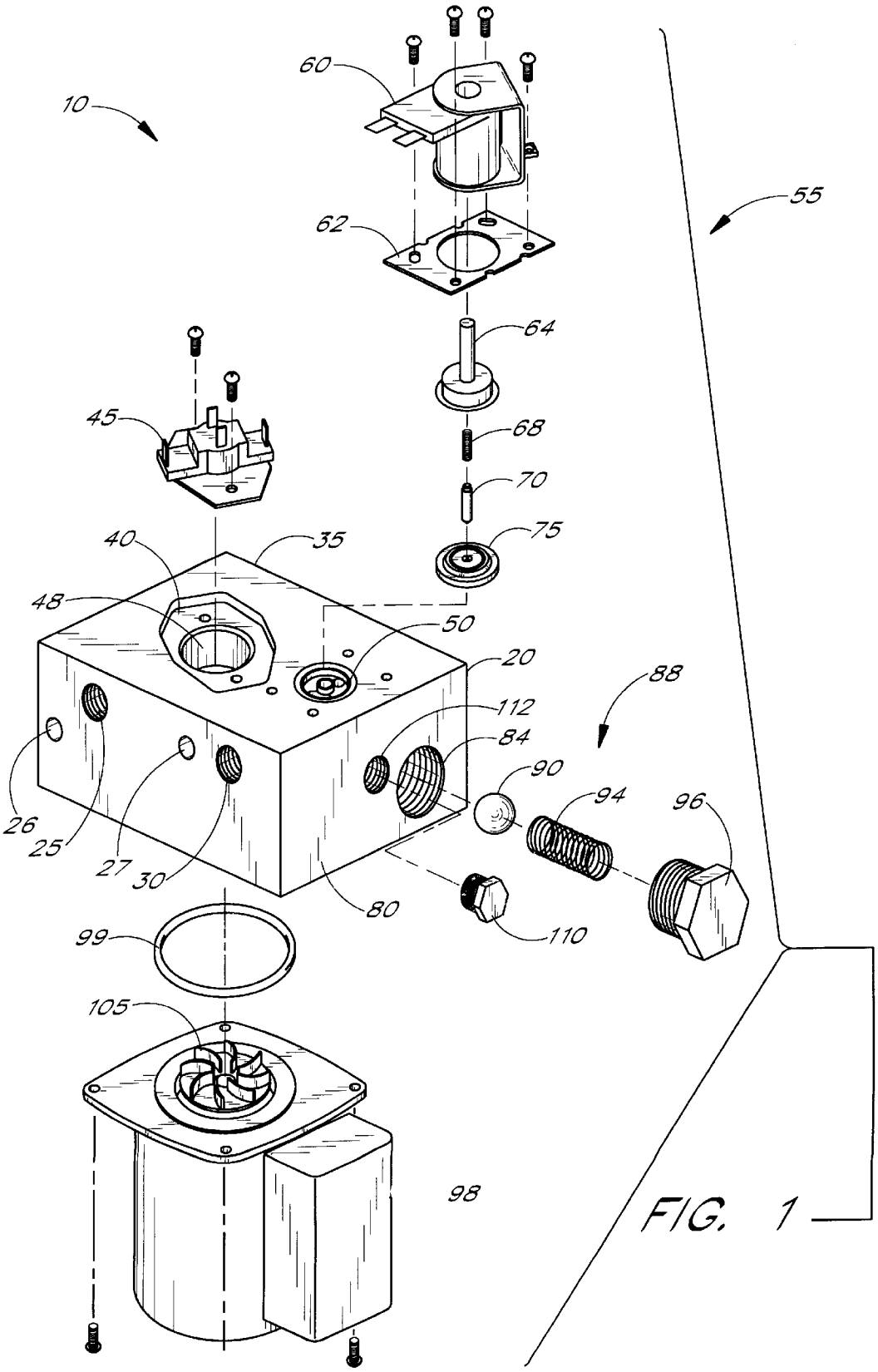
FIG. 1 is an exploded perspective view of one embodiment of a water recirculation manifold.

FIG. 1 is an exploded view of one embodiment of a water recirculation system 10. A rectangular manifold block 20 is shown having a hot water inlet 25, mounting channels 26, 27 and a cold water outlet 30. As will be described below, hot water from a household hot water system enters the manifold block 20 through the hot water inlet 25. Normally, the hot water inlet 25 is connected through a tube or pipe (not shown) to a hot water valve under a sink.

Similarly, hot water that enters through the hot water inlet 25 exits from the manifold block 20 through the cold water outlet 30. Normally, the cold water outlet 30 is connected through a tube pipe (not shown) to a cold water valve located under a sink.

The manifold block 20 also has a top 35 that includes an opening 40 for mounting a temperature switch 45. As will be described below, water that is drawn into the manifold block 20 through the hot water inlet 25 contacts the temperature switch 45 through a lumen 48. Also included on the top 35 is an orifice 50 for mounting a solenoid assembly 55 to the manifold block 20. The solenoid assembly 55 includes a body 60, solenoid plate 62, plunger 64, spring 68, pin 70, and flexible diaphragm 75. When the solenoid assembly 55 is electrically activated, the pin 70 is forced upward into the flexible diaphragm 75. The flexible diaphragm 75 then bends away from the manifold block 20 to allow the flow of cold water through the manifold block 20 until hot water opens the temperature switch, which disengages the pump and solenoid. This will be described in more detail below.

The manifold block 20 has a right side 80 that has an orifice 84 for mounting a check valve assembly 88. The check valve assembly 88 includes a ball 90, spring 94, and mounting screw 96. Preferably, the ball 90 is a ⅝" outer diameter delrin ball which fits snugly into the orifice 84. When engaged, the mounting screw 96 fits into the orifice 84 to engage the ball 90 within the manifold block 20. The check valve assembly 88 allows water to only flow in the direction from the hot water inlet 25 to the cold water outlet 30.

A recirculation pump 98 mounts to the lower surface of the manifold block 20 through O-ring seal 99. As shown, the recirculation pump 98 includes a series of blades 105 that spin to force water through the manifold block 20.

Also shown is a plug 110 that fits within an opening 112 on the right side 80 of the manifold block 20. The plug 110 closes the opening 112 that is created during the process of drilling the inner lumens of the manifold block 20.

Figure 2:
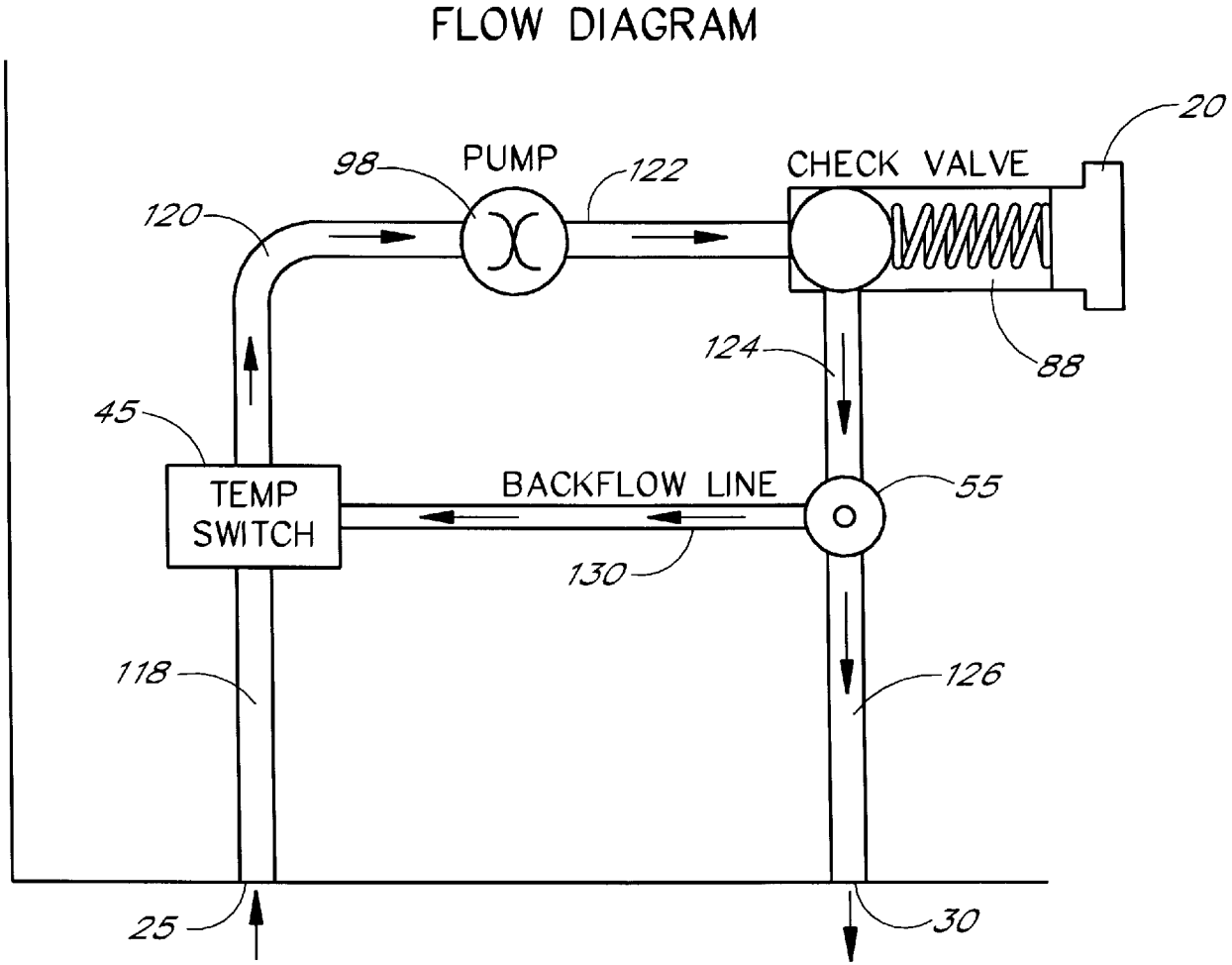
FIG. 2 is a flow diagram illustrating the flow of fluids through a manifold block of the invention.

FIG. 2 is an operational diagram of the manifold block 20. As shown, water enters the hot water inlet 25 and flows through an inlet lumen 118 to the temperature switch 45. When the temperature of water at the hot water inlet 25 drops below a predetermined threshold, the temperature switch 45 activates the water recirculation pump 98 and solenoid. Water from the hot water inlet 25 then flows inside a lumen 120 to the recirculation pump 98. From the recirculation pump 98, the water flows through a lumen 122 to the check valve 88. As shown, the check valve 88 prevents water from flowing in the opposite direction within the lumen 122, towards the recirculation pump 98.

Once water from the hot water inlet 25 has passed the check valve 88, it flows into a lumen 124 and to the solenoid assembly 55. At this point, the water path is divided into a large lumen 126 and a smaller backflow line 130. Water flowing through the large lumen 126 exits the cold water outlet 30, whereas water entering the backflow line 130 is returned to the temperature switch 45.

Figure 3:
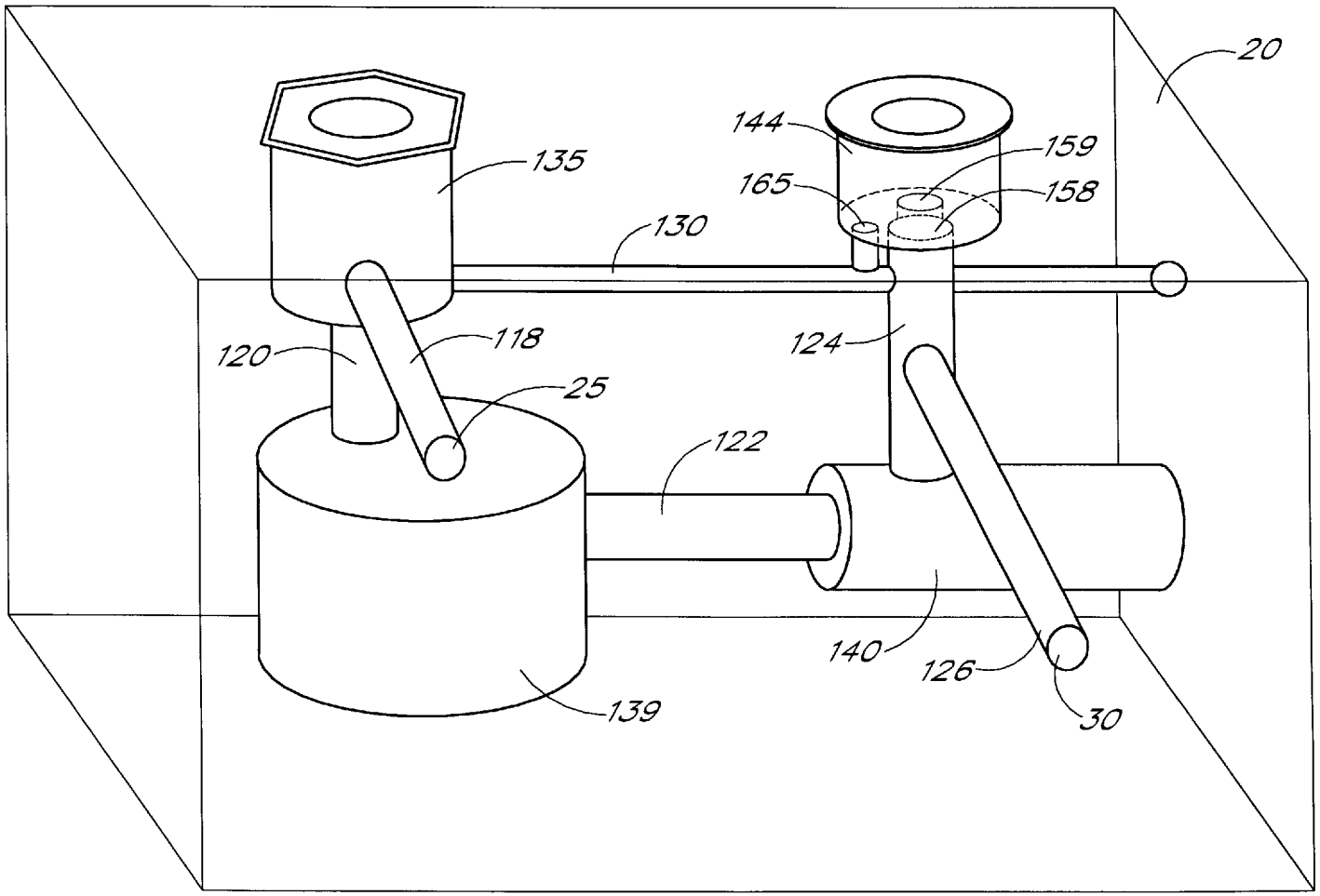
FIG. 3 is a transparent perspective view of one embodiment of a manifold block of the invention.

Referring to FIG. 3, a perspective phantom-line view of one embodiment of the invention is illustrated. The manifold block 20 includes a hot water inlet 25 that allows hot water to enter the inlet lumen 118 and flow to a temperature switch chamber 135 that is adapted to mount with the temperature switch 45. The temperature switch chamber 135 has an opening to the lumen 120 that allows water to flow to a pump chamber 139. The pump chamber is shaped to fit the upper portion of a water pump so that the pump can mount directly into the pump chamber 139 without modification. Although in one embodiment of the invention, the pump is mounted to the manifold by screws, it should be noted that other means of mounting the pump to the manifold are contemplated. For example, the inner cylindrical walls of the pump chamber can be scored with screw threads so that the recirculation pump 98 can be easily screw threaded into the pump chamber 139.

The pump chamber 139 connects through the lumen 122 to a cylindrical check valve chamber 140. As can be envisioned, the check valve chamber 140 is formed to snugly fit the ball 90 and spring 94 (FIG. 1). The check valve chamber 140 connects to the vertical lumen 124 that terminates at a solenoid chamber 144. Thus, water that flows through the check valve 88 moves through the vertical lumen 124 to the solenoid chamber 144.

The solenoid chamber 144 includes three orifices: a cold water orifice 158, a check valve orifice 159 and a backflow orifice 165. The cold water orifice 158 connects the solenoid chamber 144 to the lumen 126 and cold water outlet 30. The check valve orifice 159 connects to the check valve chamber 140 and the backflow orifice 165 connects the solenoid chamber 144 to the backflow line 130.

Figure 4:
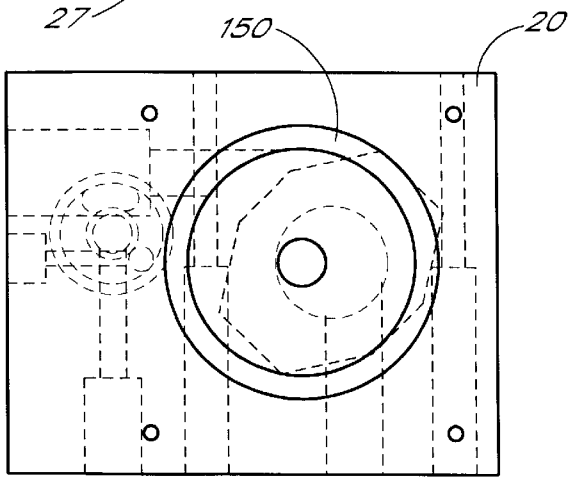
FIG. 4 is a bottom view of one embodiment of a manifold block of the invention.

FIG. 4 is a bottom view of the manifold block 20, and illustrates the pump chamber 139 in the bottom of the manifold block 20. As shown, the pump chamber 139 connects the recirculation pump 98 to the manifold block 20.

Figure 5:
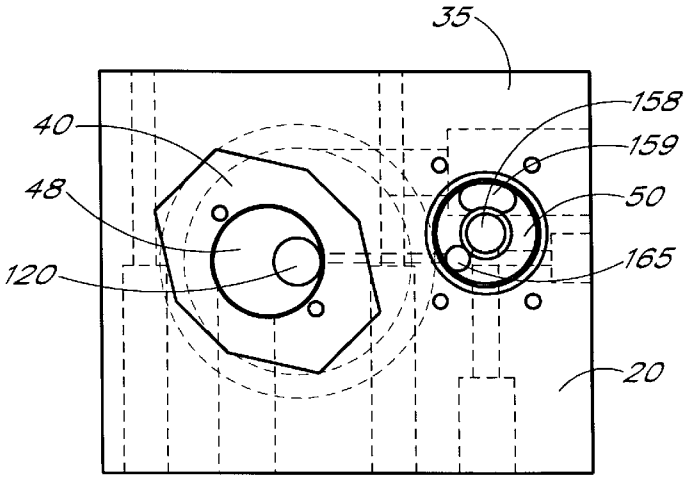
FIG. 5 is a top view of one embodiment of a manifold block of the invention.

Referring now to FIG. 5, a top view of the manifold block 20 is provided. The opening 40 in the top 35 is illustrated along with the inner lumen 48 within the opening 40 that defines the temperatures switch chamber 135. In addition, the opening 50 for the solenoid assembly 55 is illustrated. The opening 50 defines the solenoid chamber 144 within the manifold block 20.

As shown, the temperature switch chamber 135 includes access to the lumen 120. In addition the solenoid chamber 144 is shown in FIG. 5, including the cold water orifice 158 and the backflow orifice 165. The opening 159 is also shown in the opening 50 for the solenoid assembly 55. The opening 159 provides a passage way from the check valve assembly 88 to the solenoid chamber 144.

Figure 6:
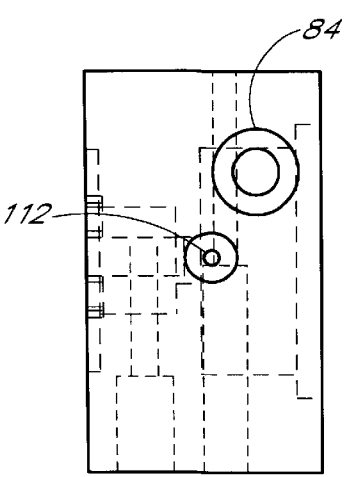
FIG. 6 is a right side view of one embodiment of a manifold block of the invention.

FIG. 6 provides a view of the right side of the manifold block 20 and shows the opening 84 and opening 112.

Figure 7:
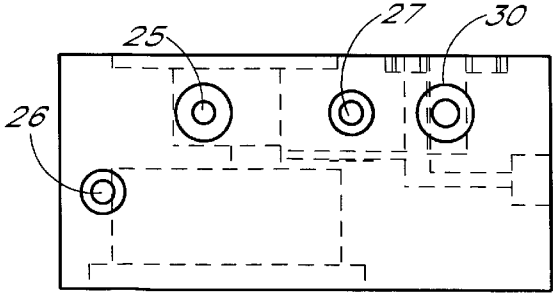
FIG. 7 is a front view of one embodiment of a manifold block of the invention.

FIG. 7 is an illustration of the front view of the manifold block 20 showing the hot water inlet 25 and cold water outlet 30. In addition, a pair of mounting channels 26, 27 are shown that traverse the interior surface of the manifold block 20 and emerge out the opposite side. The mounting holes 26, 27 are used to mount the manifold block 20 to a housing (not shown).

Figure 8:
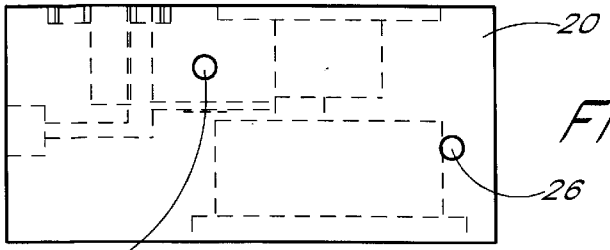
FIG. 8 is a rear view of one embodiment of a manifold block of the invention.

FIG. 8 provides an illustration of the rear of the manifold block 20. The mounting holes 26, 27 are illustrated as protruding through the rear of the manifold block 20.

Other Embodiments

Figure 9:
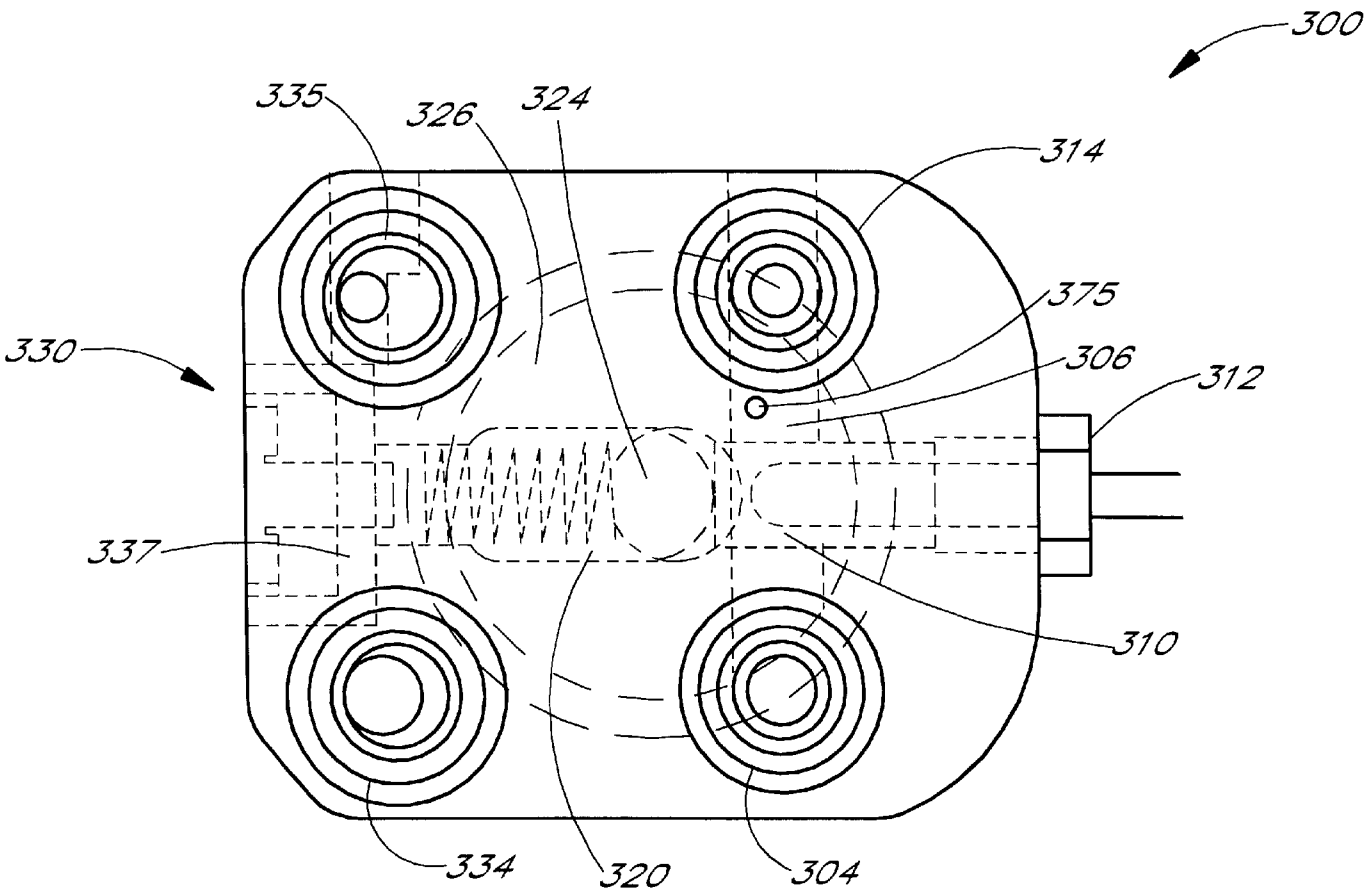
FIG. 9 is a top view of an alternate embodiment of a manifold block of the invention.

FIG. 9 provides a top view illustration of another embodiment of a preferred water recirculation manifold 300. As illustrated, this manifold is also adapted to mate with a hot water supply line (not shown) through a hot water inlet port 304. The hot water inlet port 304 communicates through an internal lumen 306 with a temperature probe chamber 310. As illustrated in FIG. 9, a temperature probe 312 is shown mounted into the temperature probe chamber 310.

As can be envisioned, water that enters the recirculation manifold 300 from the hot water inlet 304 is directed over the temperature probe 312 by passing into the temperature probe chamber 310. In addition, the manifold 300 provides a hot water outlet port 314 which is adapted to mate with a hot water output line that connects to a hot water faucet (not shown). Water can travel from the inlet 304, across the lumen 306, and out the outlet 314 when the hot water faucet is opened.

The temperature probe chamber 310 communicates with a check valve chamber 320, which is shown with a ball and spring system 324. The ball and spring system 324 is biased to that water can enter from the temperature probe chamber 310, but water cannot exit in the opposite direction.

Once water has passed through the check valve chamber 320, it is directed downward, into a pump chamber 326 that houses an electrical pump (not shown). When activated, the pump will move water from the hot water inlet 304 towards the pump chamber 326. The water is then expelled from the pump chamber 326 to a solenoid valve chamber 330. As explained more specifically with reference to FIG. 10, the solenoid chamber 330 has an inlet and an outlet.

Water from the pump chamber 326 flows into the solenoid chamber inlet, and then back out the solenoid chamber outlet. In use, a solenoid, similar to solenoid 60 (FIG. 1), is mounted into the solenoid chamber 330. When electrically disengaged, the solenoid prevents water from flowing through the solenoid chamber and out a cold water supply port 334.

A cold water outlet port 335 connects to a cold water faucet (not shown) through a lumen 337 to the cold water supply port 334 so that cold water is sent to the cold water faucet.

Figure 10:
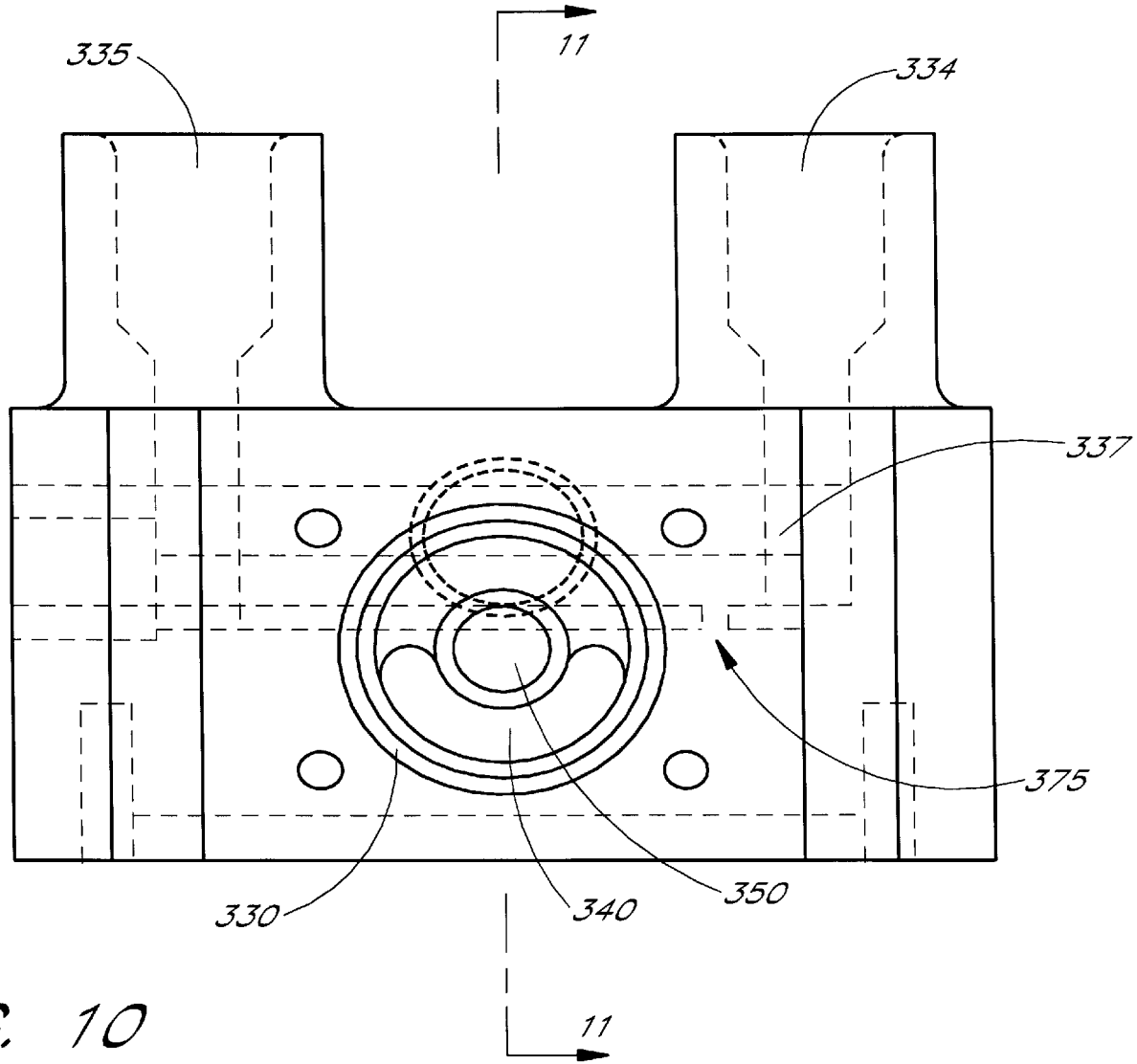
FIG. 10 is a side view of an alternate embodiment of a manifold block of the invention.

A detailed view of the solenoid chamber 330 is presented in FIG. 10, which illustrates an inlet, port 340 and outlet port 350. It should be realized that when the solenoid is in place, it will electrically control the flow of water from the inlet port 340 to the outlet port 350.

Figure 11:
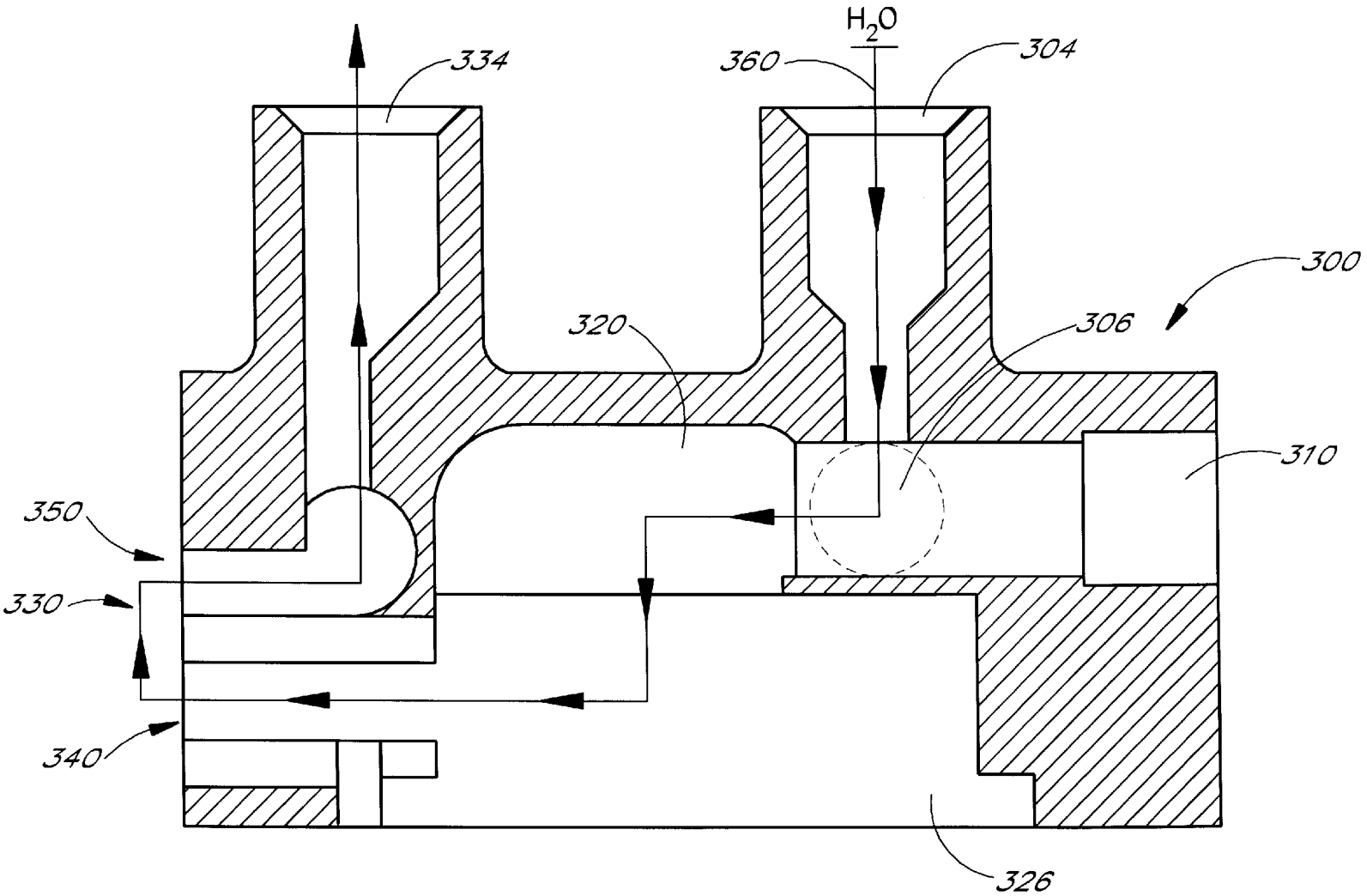
FIG. 11 is a cross-sectional view of an alternate embodiment of a manifold block of the invention taken along line II of FIG. 10.

FIG. 11 is a cross sectional view of the recirculation manifold 300 that shows the path 360 of water flowing through the system if the pump is activated. As indicated, in this embodiment, the water flows into the inlet 304. The water then moves through the internal lumen 306 to the temperature probe chamber 310. From the temperature probe chamber 310, the water flows into the check valve chamber 320 before descending into the pump chamber 326.

If the pump is active, it will move water from the pump chamber 326 to the solenoid input 340 and then to the cold water supply port 334. In this manner, the water is re-circulated from the hot water inlet 304 to the cold water supply port 334.

A backflow line 375 is located between the pump chamber 326 and the lumen 306 so that a small amount of cold water can flow back to the temperature probe chamber 310 when the hot water faucet is open. Because of the lower pressure created by opening the hot water faucet, cold water is moved from the cold water supply, through the solenoid chamber and into the pump chamber 326. Because the backflow line connects the pump chamber 326 with the lumen 306, the checkvalve 320 is bypassed. Thus, a small amount of cold water can be returned to the temperature probe to provide the advantages discussed above.

It should be understood that the scope of the invention is not limited to water recirculation manifolds. Other embodiments, such as water recirculation systems that incorporate the manifold block 20 are contemplated. The contemplated water recirculation system could have, for example, an outer housing that encloses the manifold block 20. In addition, a timer could be incorporated into the system so that it only becomes activated during certain hours. In that manner the system would not recirculate water unnecessarily during times when no one is at home.

While particular embodiments of the invention have been described in detail, it will be apparent to those skilled in the art that these embodiments are exemplary rather than limiting, and the true scope of the invention is defined by the claims that follow.

What is claimed is:

1. A water recirculation manifold formed from a generally solid material comprising:

a hot water inlet;

a first internal lumen formed within the material and connecting the hot water inlet to a first chamber, wherein the first chamber is formed within the material and adapted to receive a temperature switch;

a second internal lumen formed within the material and connecting the first chamber to a second chamber, wherein the second chamber is formed within the material and adapted to receive a pump; and a third internal lumen formed within the material and connecting the second chamber to a cold water outlet.

2. The water recirculation manifold of claim 1, further comprising a third chamber connected to the second chamber and the cold water outlet, wherein the third chamber is adapted to receive a check valve.

3. The water recirculation manifold of claim 2, further comprising a fourth chamber connected to the third chamber and the cold water outlet, wherein the fourth chamber is adapted to receive a solenoid valve.

4. The water recirculation manifold of claim 3, further comprising a backflow lumen connecting the fourth chamber to the first chamber.

5. The water recirculation manifold of claim 1, wherein the generally solid material comprises plastic.

6. A water recirculation system, comprising:

a hot water inlet; and a generally solid manifold comprising:

a first internal lumen connecting the hot water inlet to a first chamber formed within the manifold, wherein the first chamber is removably connected to a temperature switch;

a second internal lumen formed within the manifold and connecting the first chamber to a second chamber, wherein the second chamber is formed within the manifold and removably connected to a pump; and a third internal lumen formed within the manifold and connecting the second chamber to a cold water outlet.

7. The water recirculation system of claim 6, further comprising a third chamber connected to the second chamber and the cold water outlet, wherein the third chamber is removably connected to a check valve.

8. The water recirculation system of claim 7, wherein the check valve comprises a ball and spring.

9. The water recirculation system of claim 7, further comprising a fourth chamber connected to the third chamber and the cold water outlet, wherein the fourth chamber is adapted to receive a solenoid valve.

10. The water recirculation system of claim 9, further comprising a backflow lumen connecting the fourth chamber to the first chamber.

11. The water recirculation system of claim 6, wherein the generally solid manifold is made of plastic.

12. The water recirculation system of claim 6, wherein the system is connected to a household water supply.

13. The water recirculation system of claim 6, further comprising a timer for activating the system at preselected times.

14. A fluid recirculation system, comprising:

a hot fluid inlet; and a manifold formed from a solid material comprising:

a first internal lumen formed within the manifold and connecting the hot fluid inlet to a first chamber, wherein the first chamber is formed within the manifold and removably connected to a temperature switch;

a second internal lumen formed within the manifold and connecting the first chamber to a second chamber, wherein the second chamber is formed within the manifold and removably connected to a pump;

a third internal lumen formed within the manifold and connecting the second chamber to a cold fluid outlet;

a third chamber formed within the manifold and connected to the second chamber and the cold fluid outlet, wherein the third chamber is removably connected to a check valve; and a fourth chamber formed within the manifold and connected to the third chamber and the cold fluid outlet, wherein the fourth chamber is adapted to receive a solenoid valve.

15. The fluid recirculation system of claim 14, wherein the check valve comprises a ball and spring.

16. The fluid recirculation system of claim 14, further comprising a backflow lumen connecting the fourth chamber to the first chamber.

17. The fluid recirculation system of claim 14, wherein the manifold is made of plastic.

18. The fluid recirculation system of claim 14, wherein the fluid is water.

19. The fluid recirculation system of claim 14, further comprising a timer for activating the system at preselected times.

* * * * *